United States Patent [19]

Schiel et al.

[11] Patent Number: 4,520,578

[45] Date of Patent: Jun. 4, 1985

[54] DRYING CYLINDER ADAPTED TO BE HEATED WITH STEAM

[75] Inventors: Christian Schiel; Georg Zürn; Karl Schmid, all of Heidenheim, Fed. Rep. of Germany

[73] Assignee: J.M. Voith GmbH, Fed. Rep. of Germany

[21] Appl. No.: 492,432

[22] Filed: May 6, 1983

[30] Foreign Application Priority Data

May 26, 1982 [DE] Fed. Rep. of Germany ..... 3219714

[51] Int. Cl.[3] ..... F26B 25/20

[52] U.S. Cl. ..... 34/110; 34/119; 34/124; 165/90

[58] Field of Search ..... 34/110, 113, 124, 125, 34/119; 165/89, 90

[56] References Cited

U.S. PATENT DOCUMENTS

| | | | |
|---|---|---|---|
| 1,640,855 | 8/1927 | Shlick | 34/110 |
| 2,151,049 | 3/1939 | Laing | 34/110 |
| 3,099,543 | 7/1963 | Malmstrom . | |

FOREIGN PATENT DOCUMENTS

| | | | |
|---|---|---|---|
| 2361973 | 6/1975 | Fed. Rep. of Germany | 34/110 |
| 334314 | 5/1972 | U.S.S.R. | 34/110 |

OTHER PUBLICATIONS

J. M. Voith GmbH Publication p. 2253, Undated.

Wochenblatt fur Papierfabrikation 1977, pp. 447–458.

*Primary Examiner*—Larry I. Schwartz

*Attorney, Agent, or Firm*—Ostrolenk, Faber, Gerb & Soffen

[57] ABSTRACT

A drying cylinder adapted to receive steam therein includes a cylindrical cylinder jacket and two end covers. There is a flange connection between the jacket and the covers. The jacket has a rectangular cross-section flange. The covers have an L-shaped flange which receives the end flange of the cover. The covers are concave to the outside of the cylinder. The point of intersection of a curved line through the cover and of the axial center line of the axial arm of the cover flange lies at a distance from the outer face of the flange of the end cover that is at most about 60% of the axial length of the axial arm of that flange. There is thermal insulation on the axially exterior side of each cover.

10 Claims, 2 Drawing Figures

DRYING CYLINDER ADAPTED TO BE HEATED WITH STEAM

BACKGROUND OF THE INVENTION

The invention relates to a drying cylinder which is adapted to be heated with steam, particularly for paper making machines.

The invention can preferably be applied to so-called crepe cylinders, whose outside diameters may, in the extreme case, amount to more than 6 meters and which are intended for paper making machines which work at high speeds (of the order of 2,000 meters per minute). Crepe cylinders of this kind are heated with steam which is at relatively high pressure, because the high working speed gives rise to very high heat flow density in the cylinder jacket. The invention can, however, also be applied to glazing cylinders, although these are operated at lower working speeds and are heated with steam which is at lower pressure.

Prior art devices are disclosed in the following publications:

1. J. M. Voith GmbH Publication p 2253.
2. German Auslegeschrift No. 1,160,712 equivalent to U.S. Pat. No. 3,099,543.
3. Wochenblatt für Papierfabrikation 1977, pages 447–458.

The essential parts of a drying cylinder include a hollow, tubular cylinder jacket, two cylinder covers covering over the ends of the jacket, and a hollow shaft entering the cylinder through at least one cover. To secure the jacket to the cylinder covers, the jacket is provided at each end with a flange of approximately rectangular cross-section. In above-noted Publication No. 1, the axial length of the flange cross-section is greater than its radial thickness. In addition, each cover has a connection flange whose cross-section is L-shaped. The L embraces the jacket flange in such a manner that centering is provided over a relatively great axial length between the jacket and the cover. The covers are curved in shape in the direction of the interior of the cylinder and have relatively thin walls.

The covers of the drying cylinders described in Publications Nos. 2 and 3 have only a very short centering surface at their connection flanges. The flanges of the cylinder jacket are accordingly also fairly short in the axial direction. In Publication 2 slightly curved cylinder covers are shown, while in Publication 3 the cylinder covers have a conical shape.

FIG. 15 of Publication 2 shows how a drying cylinder is deformed in operation. The cylinder jacket first expands as it heats up, and then it shrinks again as heat is extracted from it by the paper to be dried. On the other hand, as will be further explained below, the cylinder covers behave quite differently. Since the cover cannot follow the deformations of the cylinder jacket, relatively great stresses occur in the end regions of the cylinder jacket, near its flanges. Designers endeavor to ensure that these stresses are at most equal to the greatest stress occurring in the axial middle of the cylinder jacket. For achieving this aim, numerous different steps have previously been taken:

A. In FIG. 1 of Publication 2, the two cylinder covers are joined together by a plurality of tie rods. This is an attempt to ensure that the only slightly curved covers will bend outward under the steam pressure to a smaller extent than previously occurred (see FIG. 13 in comparison with FIG. 15). This arrangement, however, is heavy and expensive.

B. An attempt to achieve a similar effect is made with the constructon shown in FIG. 5 of Publication 2. Here the diameter of the hollow shaft is increased and the covers are curved outward. Here again the total weight is increased. In addition, the installed length in the region of the covers is greater than previously.

C. In Section 3 (Page 454) of Publication 3, it is stated that with conical covers, a reduction of the inside diameter of the cover (and hence of the diameter of the flange on the hollow shaft) and a simultaneous reduction of the wall thickness of the covers are advantageous. However, conical covers must in any case have a relatively great wall thickness in order to be able to withstand the steam pressure. Publication 3 then also points out the influence of the ratio between the length of the cylinder jacket and the width of the paper.

The constructions described at A, B and C above all have the additional disadvantage that because of the very short centering surfaces (in the axial direction), there is a danger that the covers will not follow the deformations of the cylinder jacket to the desired extent, so that the tightness of the flange connection will leave much to be desired. This danger becomes even greater if a coacting roller is pressed against the drying cylinder. An oscillating load is thereby superimposed on the previously mentioned stresses, and this may cause leakage in the flange connections.

D. For the drying cylinder according to Publication 1, a different method has been adopted from that employed in Publications 2 and 3, namely the previously mentioned shape of the flange connection (with a long centering surface), for ensuring that the stresses at the ends of the jacket will not exceed a permissable value. Complete tightness of the drying cylinder can also be ensured by the relatively stiff flange connection. Another advantage of this construction is the sharply curved shape of the covers. As a result, the covers can have only a slight wall thickness, while nevertheless being only slightly deformed under the steam pressure.

With the construction known from Publication 1, however, difficulties may arise if an extremely high working speed is required and accordingly there is a still further increased heat flow density. In such cases, it has been found that additional steps are necessary to reduce the stresses in the end regions of the cylinder jacket. This is particularly the case if superheated steam is used and if the covers are to be provided with thermal insulation on their outward sides in order to save energy. The covers may then assume superheating temperatures and expand accordingly. This expansion is transmitted by the covers to the cylinder jacket, on which the above-mentioned stresses are thus imposed. For these reasons, it has not previously been permissible to provide thermal insulation on the covers when superheated steam was used.

SUMMARY OF THE INVENTION

The object of the invention is to improve the drying cylinder known from Publication 1 in such a manner that a flange connection is retained which ensures perfect tightness, and the stresses in the cylinder jacket are kept within permissible limits even with an extremely high heat flow density.

The invention provides a drying cylinder which is adapted to be heated by steam. It includes a cylinder jacket and two cylinder end covers. At each end face, the cylinder jacket has an annular flange of substantially rectangular cross-section, whose axial length is at least equal to its radial thickness. The cylinder end covers each have a portion which is concavely curved in the direction of the interior of the cylinder. Each cover also has a connection flange. The cross-section of the connection flange is substantially L-shaped, and that flange comprises an axial arm extending toward the center of the cylinder, and a radial arm. The length of the axial arm is at least equal to the length of the radial arm such that when the cylinder is viewed in cross-section through the cover connection flange, the point of intersection of the center line of the curved cover portion with the center line of the axial arm of the connection flange lies in the middle region of the axial arm.

The considerations which led to the invention included the fact that during operation of the cylinder, the radial arm of the cover connection flange is heated at high working speeds to a lesser extent than the remainder of the cylinder cover. This occurs because it is the part situated furthest to the outside in the radial direction, and it is cooled by ventilation. In the previous construction (Publication 1), this apparently has the consequence that the radial arm of the cover connection flange expands to a lesser extent in the radial direction than the curved portion of the cover. This becomes entirely feasible if it is taken into account that the axial arm of the L-shaped flange is situated between the curved portion of the cover and the radial arm of this flange. From this consideration, it can be concluded that in the case of the cylinder according to Publication 1, when considerable thermal expansion of the covers occurs, the entire flange connection, viewed in section, "tilts" precisely in the opposite direction to that shown in FIGS. 13 and 15 in Publication 2. Although this "tilting deformation" is not very great because of the stiffness of the flange connection, nevertheless it becomes perceptible when thermal insulation is applied to the curved portion of the cover, not including the connection flange. A particularly high temperature difference then occurs between the connection flange and the curved portion of the cover, particularly when superheated steam is used.

The construction according to the invention counteracts the above-described tilting deformation of the flange connection.

Preferably, the distance between the point of intersection and the outer face of the connection flange amounts to at most about 60% of the length of the axial arm. Through slight variation of this distance, it is possible to ensure that the curved portion of the cylinder cover, which tries to expand in the radial direction, acts on the flange connection in such manner that the flange connection no longer tilts at all, either in one direction or the other. Alternatively, a calculated slight tilting deformation in the sense of Publication 2, can be achieved. In any case, it is possible to keep the stresses in the end regions of the cylinder jacket within permissable limits, even when the covers are highly heated. Other deformation forces, for example the centrifugal forces which increase with increasing working speed, can also be mastered.

There were initial objections to the invention due to the fear that excessive stresses would occur in the covers. Such misgivings, however, have been proven groundless.

The success of the invention is also attributable to the retention of the very stiff flange connections, i.e. the L-shaped cross-section of the cover connection flanges with the centering surfaces of great axial length, which are used in previous constructions (Publication 1). Complete tightness of the flange connections can thus also be obtained, as previously. Moreover, the sharp inward curvature of the covers is retained or is even increased, so that the covers can still have a relatively slight wall thickness, as previously.

The essential advantage of the construction in accordance with the invention, however, consists in that substantially higher temperatures can now be permitted in the cylinder covers than were previously possible. As already mentioned, such high temperatures occur when superheated steam is used and, for the purpose of saving energy, the cylinder covers are provided on the outside with thermal insulation, in order to avoid unnecessary emission of heat. In other words, only by use of the invention has it become possible, when using superheated steam, to provide thermal insulation safely on the covers.

Other objects and features of the invention will be apparent from the following description of an embodiment of the invention.

DESCRIPTION OF A PREFERRED EMBODIMENT

Figure 1:
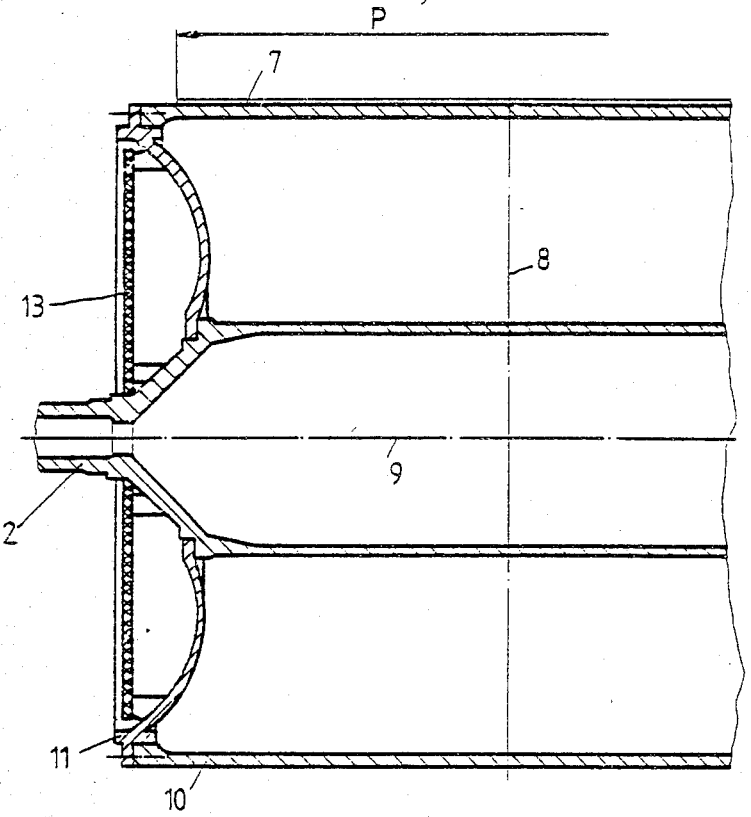
FIG. 1 shows in simplified manner a partial longitudinal section of an embodiment of crepe cylinder, according to the invention.

FIG. 1 shows a crepe cylinder which is particularly suitable for use in high-speed tissue paper making machines. The crepe cylinder includes the cylinder jacket 10, one of the two cylinder covers 11 over the end of the cylinder, the hollow shaft 12 through the cover and a thermal insulation plate 13 disposed on the end face of the cylinder. The cylinder has the axis of rotation 9 and the axial center 8. The cylinder helps dry the paper web 7 having the width shown by the dimension arrow P.

Figure 2:
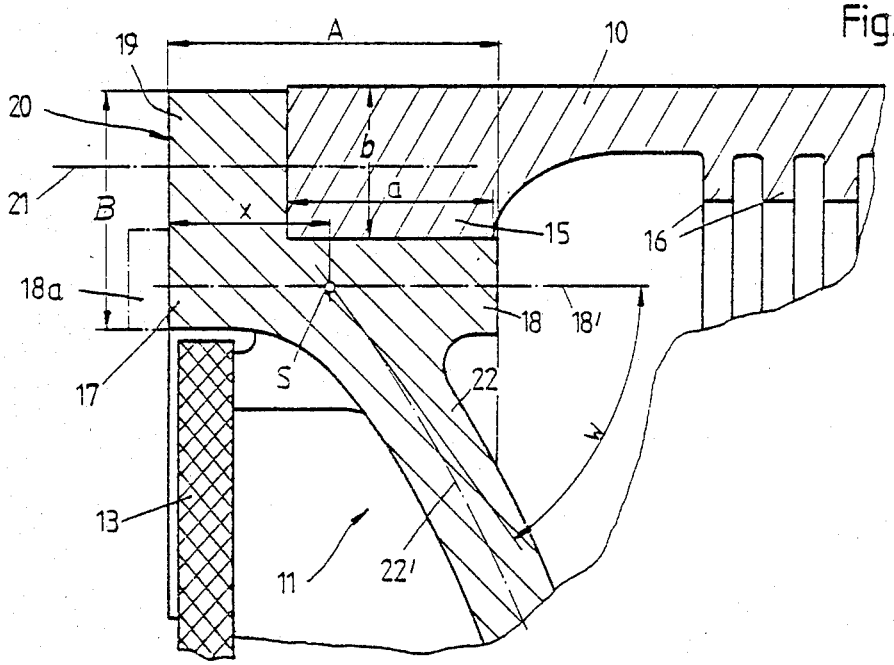
FIG. 2 shows, on a larger scale, a portion of FIG. 1.

Further details can be seen from FIG. 2, which is a cross-section through the flange connection between the cylinder jacket 10 and the cover 11. The cylinder jacket 10 has an annular flange 15 of substantially rectangular cross-section at its end. The axial length a of the flange is greater than its radial thickness b. In addition, ribs 16 are provided on the inside of the cylinder jacket, extending in the peripheral direction, in order to increase the transfer of heat.

The connection flange 17 of the cylinder cover 11 for connecting to the flange 15 is L-shaped in cross-section, comprising an axial arm 18 extending toward the cylinder center 8 and a radial arm 19 located axially to the outside of the connection flange. In accordance with the dimension ratios of the jacket flange 15, the length A of the axial arm 18 is greater than the length B of the radial arm 19. The axial arm 18 may in certain circumstances have an extension 18*a* (shown in dash-dot lines in FIG. 2), which extends beyond the outer end face 20 of the connection flange 17. This extension, however, is of no significance to the invention.

The jacket 10 and the cover 11 are joined together in the usual manner by numerous bolts. In FIG. 2, only the center line 21 of one of these bolts is shown.

The cylinder cover 11 has the inwardly or concavely curved portion 22 in FIG. 2. The covers are curved to extend inwardly of the cylinder and toward each other.

The curvature of this cover portion 22 and its position relative to the connection flange 17 are determined by its curved, cross-sectional center line 22'. The latter line 22' intersects the straight center line 18' located at the radial center of the axial arm 18. The intersection occurs at the point of intersection S, which lies a determined distance x away from the outer end face 20 of the flange 17. This distance x amounts at most to about 60% of the length A of the axial arm 18. The value of the distance x is preferably in the range between 25% and 50% of the length A.

In order to enable the wall thickness of the curved cover portion 22 of the cover to be made as small as possible, it is sought to give the curved portion the smallest possible radius of curvature. The value of this curvature is also expressed by the angle w which is measured between the center lines 18' and 22' at the point of intersection S. In the example illustrated this angle w amounts to only about 50° . The value of the angle w nevertheless also depends on other constructional factors, particularly on the ratio between the greatest diameter of the cylinder jacket 10 and the greatest diameter of the hollow shaft 12. In the example illustrated, this ratio is about 3:1.

The other parts of the crepe cylinder, for example, bearings and pipes for the steam supply and condensate discharge, are not shown in the drawings, as they are conventional.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A drying cylinder adapted to be heated with steam, comprising:

a cylindrical cylinder jacket having opposite open ends; the cylinder jacket having a flange defined on each of its open ends; each jacket flange having a substantially rectangular cross-section, and having an axial length in the direction of the axis of the cylinder which is at least as great as the radial thickness of the jacket flange;

opposite end covers covering the open ends of the jacket; each cover having a relatively small wall thickness and being curved inwardly of the jacket and toward the other cover, whereby each cover is concave as viewed from the outside of the cylinder; the cover including a connection flange thereon having a cross-section which is substantially L-shaped, wherein the connection flange includes an axial arm extending toward the axial center of the cylinder and toward the other cover and a radially outwardly extending arm located axially toward the outside of the cover; the axial arm of the connection flange having at least the same length as the radial arm thereof; the jacket flange being received in the L-shaped space defined by and lying against the arms of the connection flange;

the cylinder jacket and the covers being shaped so that when they are viewed in cross-section through the connection flange of the end cover, the point of intersection of the center line running through and along the center of the cross-section of the cover with the center line running along the radial center of the cross-section of the axial arm of the connection flange lies generally in the axial middle of the axial arm of the connection flange.

2. The cylinder of claim 1, wherein the axial arm of the connection flange has an outer face at the outside of the cover, and the distance between the point of intersection of the lines and the outer face of the connection flange is at most 60% of the length of the axial arm.

3. The cylinder of claim 2, wherein that distance is in the range of 25%–50% of the axial length of the axial arm.

4. The cylinder of claim 2, further comprising thermal insulation means disposed axially outside the covers for preventing heat loss from steam in the cylinder.

5. The cylinder of claim 1, further comprising thermal insulation means disposed axially outside the covers for preventing heat loss from steam in the cylinder.

6. The cylinder of claim 1, wherein both of the jacket and connection flanges are annular.

7. The cylinder of claim 1, wherein the connection flange is at the periphery of the cover.

8. The cylinder of claim 1, wherein the cylinder is supported on a shaft.

9. The cylinder of claim 8, wherein the shaft is hollow for introduction into the cylinder of steam.

10. A drying cylinder adapted to be heated with steam, comprising:

a cylindrical cylinder jacket having opposite open ends; the cylinder jacket having a flange defined on each of its open ends; each jacket flange having a substantially rectangular cross-section and having an axial length in the direction of the axis of the cylinder which is at least as great as the radial thickness of the jacket flange;

opposite end covers covering the open ends of the jacket; each cover having a relatively small wall thickness and being curved inwardly of the jacket and toward the other cover, whereby each cover is concave as viewed from the outside of the cylinder; the cover including a connection flange thereon at the periphery of the cover, the connection flange having a cross-section which is substantially L-shaped, wherein the connection flange includes an axial arm extending toward the axial center of the cylinder and toward the other cover and a radially outwardly extending arm located axially toward the outside of the cover; the axial arm of the connection flange having at least the same length as the radial arm thereof; the jacket flange being received in the L-shaped space defined by and lying against the arms of the connection flange; the cover being connected to a hollow shaft; and thermal insulation means disposed axially outside the covers for preventing heat loss from steam in the cylinder;

the cylinder jacket and the covers being shaped so that when they are viewed in cross-section through the connection flange of the end cover, the point of intersection of the center line running through and along the center of the cross-section of the cover with the center line running along the radial center of the cross-section of the axial arm of the connection flange lies generally in the axial middle of the axial arm of the connection flange.

* * * * *